United States Patent [19]

Smithline

[11] 4,106,196

[45] Aug. 15, 1978

[54] COIN WRAPPER CUTTING DEVICE

[75] Inventor: John P. Smithline, Columbia, Md.

[73] Assignee: Pacific Handy Cutter, Inc., Costa Mesa, Calif.

[21] Appl. No.: 794,001

[22] Filed: May 5, 1977

[51] Int. Cl.[2] ..... B26B 29/00; B25F 3/00

[52] U.S. Cl. ..... 30/294; 30/286

[58] Field of Search ..... 30/294, 286, 289

[56] References Cited

U.S. PATENT DOCUMENTS

| | | | |
|---|---|---|---|
| 2,383,368 | 8/1945 | Callaghan | 30/289 |
| 2,437,896 | 3/1948 | Rutledge | 30/294 |
| 2,688,187 | 9/1954 | Pauli | 30/294 X |
| 2,743,523 | 5/1956 | Honey | 30/294 X |
| 2,853,778 | 9/1958 | Pratt et al. | 30/294 |
| 4,001,934 | 1/1977 | Bell | 30/294 UX |

FOREIGN PATENT DOCUMENTS

| | | | |
|---|---|---|---|
| 1,501,959 | 10/1967 | France | 30/286 |
| 2,108,466 | 9/1972 | Fed. Rep. of Germany | 30/294 |

*Primary Examiner*—Al Lawrence Smith
*Assistant Examiner*—J. T. Zatarga
*Attorney, Agent, or Firm*—Poms, Smith, Lande & Glenny

[57] ABSTRACT

A device for longitudinally slitting generally cylindrical objects has body means for supporting a cutting element, alignment means for positioning the cutting element relative to the body means, bearing shoulder means for longitudinally aligning the cylindrical object with respect to the cutting element and positioning the cylindrical object such that a surface thereof contacts the cutting element and protective means adjacent the cutting element for protecting the cutting portion of the cutting element when the device is not in use and, at the same time, being moveable to expose the cutting portion of the cutting device when a cylindrical object bears against the bearing shoulder means.

2 Claims, 5 Drawing Figures

COIN WRAPPER CUTTING DEVICE

BACKGROUND OF THE INVENTION

The present invention relates in general to devices for opening cylindrical containers. Specifically, the present invention relates to devices which cut through the cylindrical container along a longitudinally extending surface of the container, as opposed to those devices which cut circumferentially around an end surface of the cylindrical container.

Prior approaches to the problem of cutting into a cylindrical object or container have principally been directed toward making either circumferential cuts about an end surface of the cylinder or toward making circumferentially oriented cuts through a side wall of the cylinder. Exemplary of these two approaches are the common can opener and the bologna slicer in the meat market.

For certain substances, it is undesirable to rely on an opening which is limited to the cross-sectional area of the cylinder to empty the contents from the cylindrical container. Extremely viscous substances or solid cylindrical objects having a diameter substantially equal to the inside diameter of the cylinder are often very difficult to remove through an open end of the cylinder. In these cases, it has been found to be desirable to open the cylinder longitudinally.

Due to the propensity of a cylinder to roll away from a cutting instrument, attempts to cut through the side wall of a cylinder tend, in general, to be quite dangerous. The cutting instrument tends to deflect from a longitudinal direction to a circumferential direction and, as the operator is generally holding the cylinder manually, a sever injury often results.

SUMMARY OF THE INVENTION

It is therefore a primary object of the present invention to disclose an improved device for longitudinally slitting generally cylindrical objects which is safe for an operator to use.

It is a further object of the present invention to disclose an improved device which longitudinally aligns a cylindrical object with respect to a cutting element and positions the cylindrical object such that a longitudinally extending surface thereof contacts the cutting element.

It is a further object of the present invention to disclose an improved device which protects the cutting portion of the cutting element when the device is not in use and which is moveable to expose the cutting portion of the cutting device during use.

Generally stated, the improved device of the present invention includes the provision of body means for supporting a cutting element and alignment means for positioning the cutting element relative to the body means. Bearing shoulder means are provided for longitudinally aligning a cylindrical object with respect to the cutting element and positioning the object such that a surface thereof contacts the cutting element. Protective means adjacent the cutting element cover the cutting portion thereof when the device is not in use. The protective means are moveable to expose the cutting portion of the cutting device when a cylindrical object bears against the bearing shoulder means.

A more complete understanding of the improvements in cutting devices in accordance with the present invention, as well as a recognition of additional objects and advantages therefore, will be afford to those skilled in the art from a consideration of the following detailed description of an exemplary embodiment thereof. Reference will be made to the append sheet of drawings which will first be discussed briefly.

DETAILED DESCRIPTION OF AN EXEMPLARY EMBODIMENT

Figure 1:
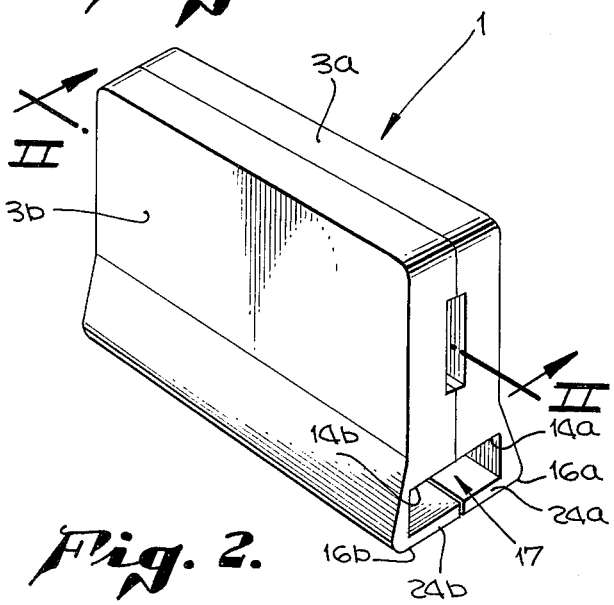
FIG. 1 is a perspective view of the cutting device of the present invention.

Referring first to FIG. 1, an assembled cutting device is shown which has body means shown generally at 1 for supporting a cutting element. Body means 1 comprises paired opposing body elements 3*a* and 3*b* which at least partially enclose the cutting element therebetween. Body elements 3*a* and 3*b* have cooperating opposing male interlocking elements 5*a* and 5*b* respectively, and Female interlocking elements 6*b* and 6*a* which receive mail interlocking elements 5*a* and 5*b* respectively when body elements 3*a* and 3*b* are in juxtaposition to provide an interlocking fit between the opposing body elements at opposing surfaces 13*a* and 13*b* respectively. This relationship is best understood by viewing FIG. 5.

Figure 3:
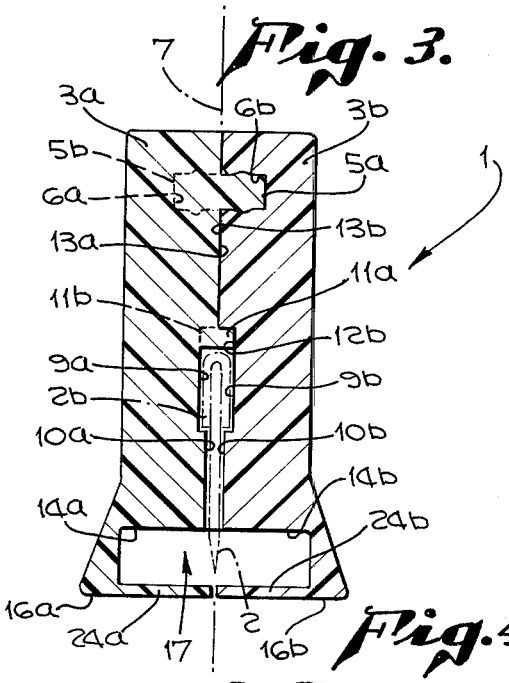
FIG. 3 is a sectional view through the plane III—III of FIG. 2 showing the relationship between the interlocking body elements and the cutting element of the present invention.
Figure 2:
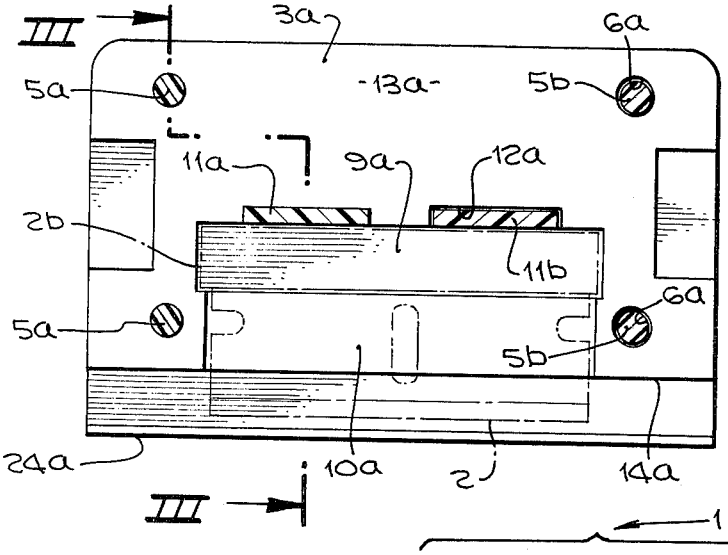
FIG. 2 is a side view through the plane II—II of FIG. 1.
Figure 5:
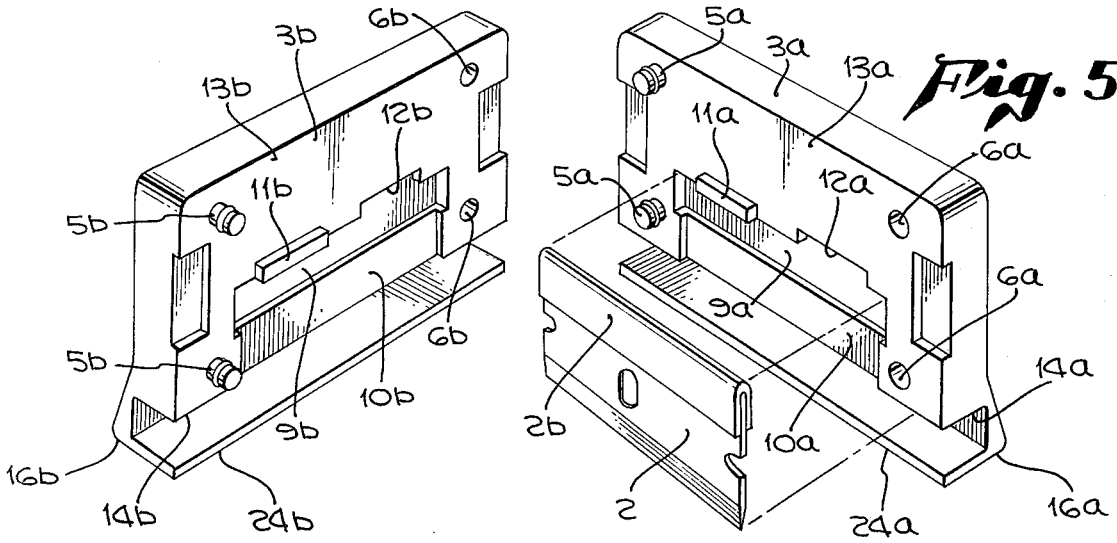
FIG. 5 is a exploded perspective view of the cutting device of the present invention showing the interrelationship between the paired opposing interlocking body elements and the cutting element.

In viewing FIG. 5 in conjunction with FIG. 3 it may be seen that a body 1 which comprises juxtaposed paired opposing body elements 3*a* and 3*b* which are interlockingly joined together at an interface 7 between opposing surfaces 13*a* and 13*b* of body elements 3*a* and 3*b* respectively supports and partially encloses a cutting blade 2 having a reinforced back 2*b* between body elements 3*a* and 3*b*.

As shown in FIGS. 3 and 5, alignment means, are provided for positioning cutting element 2 relative to body means 1, has recesses formed integrally of opposing surfaces 13*a* and 13*b* of opposing body elements 3*a* and 3*b* respectively for receiving and positioning cutting element 2. As best shown in FIG. 5, recesses 9*a* and 9*b* receive and align the reinforce back portion 2*b* of cutting element 2 while recesses 10*a* and 10*b* receive the thinner portion of cutting element 2. As may be seen in FIG. 3, cutting element 2 is positioned such that it lies between body elements 3*a* and 3*b* and projects beyond a bottom surface 14*a*/14*b* of body means 1. It should be noted further that cutting element 2 is aligned parallel to the plane of interface 7 between opposing surfaces 13*a* and 13*b* when body elements 3*a* and 3*b* are interlocked.

Figure 4:
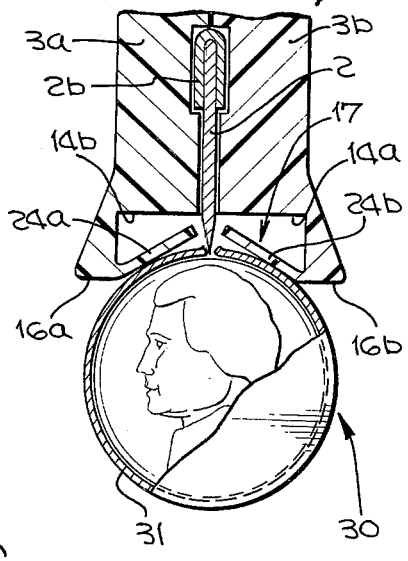
FIG. 4 is a partial sectional view as in FIG. 3 showing the deformation of the protective means to expose the cutting element when a cylindrical object bears against the bearing shoulder means of the device.

Bearing shoulder means 16*a* and 16*b*, which are best seen in FIG. 4, longitudinally align a cylindrical object with respect to cutting element 2. The cylindrical object, which in the exemplary embodiment shown in FIG. 4 is a roll of coins 30, is positioned such that the surface of the roll of coins contacts the cutting element. Shoulder elements 16*a* and 16*b* are formed integrally of body elements 3*a* and 3*b* respectively and are parallel to and off-set from opposing surfaces 13*a* and 13*b* respective such that shoulder elements 16*a* and 16*b* define a zone adjacent bottom surface 14*a*/14*b* of body means 1. Shoulder elements 16*a* and 16*b* extend on either side of, and in general parallel to, the plane of interface 7 between opposing surfaces 13*a* and 13*b* when body elements 3*a* and 3*b* are interlocked.

Protective means are provided adjacent cutting element 2 for protecting the cutting portion thereof when the cutting device of the present invention is not in use. The protective means are moveable to expose the cutting portion of cutting element 2 when a cylindrical object bears against bearing shoulder means 16*a* and 16*b*. As best seen in FIGS. 3, 4, and 5, the protective means of the instant invention comprise thin flexible sheet-like members 24*a* and 24*b* formed integral of bearing shoulder elements 16*a* and 16*b* respectively. Protective members 24*a* and 24*b* include portions extending parallel to and in space relation from body surface 14*a*/14*b* of body means 1 to cover cutting element 2 when the cutting device of the instant invention is not in use, as may best be seen in FIG. 3. Further, it should be noted that protective members 24*a* and 24*b* extend from bearing should elements 16*a* and 16*b* respectively to the plane of interface 7 between opposing surfaces 13*a* and 13*b* and are spaced from bottom surface 14*a*/14*b* of body means 1. A distance at least equal to the distance which cutting element 2 projects beyond bottom surface 14*a*/14*b*.

The specific exemplary embodiment of the present invention shown in the drawings is a coin wrapper cutting device for slitting the wrapper of a roll of coins. To use the device, a roll of coins 30 enclosed in a wrapper 31 is placed against protective members 24*a* and 24*b* which act as resilient cutting element guards. As is apparent from the appended drawings, this specific exemplary embodiment of the present invention utilizes a razor blade as the cutting element. As the roll of coins 30 is pressed against protective members 24*a* and 24*b*, the resilient nature of the protective members allows them to be deformed inwardly toward bottom surface 14*a*/14*b* of body means 1 until the roll of coins 30 rest against bearing shoulder elements 16*a* and 16*b*. At this point, cutting element 2 comes in contact with and punctures wrapper 31 of the roll of coins as is shown in FIG. 4. To slit the wrapper and empty the coins therefrom, the coin wrapper cutting device is merely moved longitudinally along the roll of coins which is maintained in alignment with cutting element 2 by the "V-block" effect of bearing shoulder elements 16*a* and 16*b*. This will produce a longitudinal slit the length of the roll of coins which will allow the coins to be readily removed from the wrapper. At the same time, the likelihood of the cutting element deflecting dangerously from the roll of coins and injuring the operator is reduced significantly. Should the cutting device be deflected by a careless operator, flexible protective members 24*a* and 24*b* would immediately return from the position shown in FIG. 4 to the position shown in FIG. 3 and once again protect the cutting edge of cutting element 2.

Having thus described an exemplary embodiment of an improved cutting device, it should be understood by those skilled in the art that various alternatives and modifications thereof may be made within the scope and spirit of the present invention which is defined by the following claims.

I claim:

1. A cutting device for longitudinally slitting generally cylindrical objects comprising the provision of:

body means for supporting a cutting element;

alignment means for positioning said cutting element relative to said body means such that said cutting element projects beyond and in a plane perpendicular to a bottom surface of said body means;

bearing shoulder means comprising shoulder elements formed integral of said body means parallel to, on each side of, and offset from said projecting cutting element for longitudinally aligning a cylindrical object with respect to said cutting element, positioning said object such that a surface thereof contacts said cutting element and supporting said cylindrical object relative to said cutting element such that protrusion of said cutting element through said surface of said cylindrical object is controlled and any slitting of said cylindrical body by said cutting element is generally along the longitudinal extent of said cylindrical body; and protective means comprising thin flexible sheet-like members extending from said bearing shoulder means to said plane of said cutting element and parallel to and spaced from said bottom surface of said body means a distance at least equal to the distance said cutting element projects beyond said bottom surface.

2. A coin wrapper cutting device for slitting the wrapper of a roll of coins comprising the provision of:

a body comprising juxtaposed paired opposing body elements interlockingly joined together at an interface between opposing surfaces of said body elements for supporting and partially enclosing a cutting blade between said body elements;

cutting blade receiving recesses integral of said opposing surfaces for positioning said cutting blade between said body elements and projecting beyond a bottom surface of said body parallel to said interface between said opposing surfaces;

bearing shoulders formed integrally of said body elements parallel to and laterally spaced from said interface and extending beyond said bottom surface of said body for aligning said roll of coins parallel to said interface and supporting said roll of coins above said bottom surface of said body with said wrapper in contact with said cutting blade; and resilient blade guards each having a thin sheet-like configuration formed integrally of said bearing shoulders and extending parallel to said bottom surface of said body from said bearing shoulders to a plane of interface between said opposing surfaces, said guards being spaced from said bottom surface of said body a distance at least equal to the distance said cutting blade projects beyond said bottom surface for protecting the cutting portion of said blade when said safety device is not in use, said guards being deformed by contact with a roll of coins to expose said wrapper to said cutting blade when said roll of coins bears against said bearing shoulders.

* * * * *